United States Patent [19]

Germann et al.

[11] Patent Number: 5,062,360

[45] Date of Patent: Nov. 5, 1991

[54] COMBINED ROTARY WEB-FED PRINTING MACHINE, ESPECIALLY FOR THE PRINTING OF SECURITIES

[75] Inventors: Albrecht J. Germann; Hans B. Bolza-Schünemann; Johannes G. Schaede, all of Wuerzburg; Joachim A. H. Lapp, Margetshochheim, all of Fed. Rep. of Germany

[73] Assignee: De La Rue Giori S.A., Lausanne, Switzerland

[21] Appl. No.: 561,698

[22] Filed: Aug. 1, 1990

[30] Foreign Application Priority Data

Aug. 30, 1989 [CH] Switzerland ..... 03148/89

[51] Int. Cl.[5] ..... B41F 5/16; B41F 9/02; B41F 11/00

[52] U.S. Cl. ..... 101/152; 101/177; 101/DIG. 49

[58] Field of Search ..... 101/181, 248, 177, 152, 101/153, 175, 179, DIG. 49; 226/24, 27, 28, 29, 30, 31, 32

[56] References Cited

U.S. PATENT DOCUMENTS

| | | | |
|---|---|---|---|
| 3,025,791 | 3/1962 | Auerbacher | 101/181 |
| 4,584,939 | 4/1986 | Giori | 101/177 |
| 4,694,749 | 9/1987 | Takeuchi et al. | 101/181 |

*Primary Examiner*—J. Reed Fisher
*Attorney, Agent, or Firm*—Kane, Dalsimer, Sullivan, Kurucz, Levy, Eisele and Richard

[57] ABSTRACT

The rotary web-fed printing machine has three successively arranged printing units, namely one offset and two intaglio printing units which are all of a similar design to sheet-fed printing units and in which the cylinders (2, 3) forming the printing nip have a plurality of sectors separated by cylinder pits (**2*a*, 3*b*). Each printing unit has, in front of the printing nip, a first paper-web store (29) and an intermittently controllable first draw-roller unit (30) and, after the printing nip, an intermittently controllable second draw-roller unit (31) and second paper-web store (32), the draw-roller units (30, 31) which have only one suction roller being controllable for the forward and backward movement of the web (P) by means of individually regulated drives (30*a*, 31*a*) and at the same time serving for the register check. In front of the first paper-web store (29) of the first printing unit (A), between the printing units within the portions limited by the respective paper-web stores and behind the second paper-web store of the last printing unit, the web (P) is moved uniformly by continuously driven draw-roller arrangements (27**), whereas during the run through the printing nip the paper-web transport takes place in the pilgrim-step mode.

16 Claims, 9 Drawing Sheets

COMBINED ROTARY WEB-FED PRINTING MACHINE, ESPECIALLY FOR THE PRINTING OF SECURITIES

FIELD OF THE INVENTION

The invention relates to a combined rotary web-fed printing machine, especially for the printing of securities, with at least two printing units arranged in succession and with a transport device conveying the paper in the form of a web through the printing units and equipped with continuously driven draw-roller arrangements.

PRIOR ART

Combined web-fed printing machines of this type are known, for example, from U.S. Pat. No. 4,584,939 and make it possible to produce securities, especially bank notes, in one operation, with a safety background which can be made by an indirect printing process, such as the offset printing process, and with a main design made by intaglio printing. For this, as is conventional of web-fed printing machines, the paper web is always transported continuously at a speed which is equal to the circumferential speed of those cylinders of the printing units forming a printing nip, since the paper web is constantly gripped between these two cylinders.

Consequently, in known web-fed printing machines with a plurality of printing units arranged in succession, there is the difficulty that, during the transport of the paper web from the first printing unit to the following printing units, tolerances and register errors are added together in the direction of transport of the web. These register errors arise particularly from the behavior of the paper which varies as a function of the ambient conditions, especially during the run through ink-drying devices between two printing units and as a result of dampening after a drying operation. The only possibility of register correction is to change the paper-web tension, but of course this is possible only within narrow limits which are often insufficient to achieve a perfect register control.

Furthermore, the setting-up of existing web-fed printing machines with a plurality of printing units is difficult and time-consuming. This is true especially when an indirectly printing printing unit and an intaglio printing unit are present, because the diameters of the cylinders of the two printing units then have to be adjusted while taking into account the different conveying behavior of the paper web which is subjected to a comparatively low pressing force in the indirectly printing printing unit, but to a high pressing force in the intaglio printing unit.

A further difficulty in web-fed printing machines with a continuous paper-web transport is that the cylinders forming the printing nip, that is to say the blanket cylinders on an indirectly printing printing unit and the plate cylinder and the impression cylinder on an intaglio printing unit, have to be given a continuous surface, and that their circumferential length must amount to a multiple of the length of one copy, that is to say of one security print, if no paper losses are to occur. These requirements entail a considerable outlay in terms of the production of the cylinders mentioned, in comparison with the cylinders used in sheet-fed printing machines, which are of sector-shaped design and in which individual blankets, printing plates or printing coverings can be clamped in a relatively simple way onto the individual cylinder sectors.

The production of a plate cylinder of a web-fed printing machine for intaglio printing is especially labor-intensive, since it is difficult to fasten the printing plates on the cylinder casing without any gaps and to guarantee that the cylinder casing will have perfect concentricity and that its outside diameter would be constant over the entire cylinder length, so that a perfect register is obtained. Furthermore, the production of the cylinder casing requires extremely accurate machining, since its inner circumference has to be made slightly conical, so that it is matched exactly to the conical form of the corresponding printing-machine shaft, on which it is fastened for the printing operation. This necessitates high production costs for the cylinder casing. The somewhat complicated production of the plate cylinder of a web-fed printing machine for intaglio printing is described, for example, in U.S. Pat. No. 4,680,067.

These difficulties do not arise in a sheet-fed printing machine, since, where the intaglio printing unit is concerned, the individual printing plates can be fastened, clamped, adjusted and exchanged individually on the sectors of the plate cylinder, and in the same way the impression cylinder can be equipped in sectors with proven printing coverings of long service, instead of being clad in a way involving a high outlay with a continuous material layer which does not have the same printing quality as the printing coverings on a sheet-fed printing machine and moreover has a shorter service life.

DE-C-3,135,696 has made known a printing unit for a rotary web-fed printing machine which allows a web to be printed with variable formats following one another and which works with four draw-roller groups, there being installed in front of the printing nip the first and the second draw-roller group and between them a web-tautening paper-web store and after the printing nip the third and the fourth draw-roller group and between them likewise a paper-web store; at the same time, the second and third draw-roller groups are respectively controlled by a regulated electromotive drive for the forward and backward movement of the web. As long as the sector-shaped blanket cylinders working in recto-verso printing act on the paper web, this is transported by the blanket cylinders; in contrast, when the cylinder pits located between the sectors run through the printing nip, the controlled draw-roller groups mentioned take over the further transport which therefore takes place in the manner of a pilgrim-step mode of operation or a so-called stop-and-go mode. This known printing unit is an offset printing unit, and if the paper web is subsequently to receive further prints the said DE-C-3,135,696 expressly states that, in such a case, there are one or more following printing units or processing stations provided which further process the paper web running at a uniform speed.

SUMMARY OF THE INVENTION

The object on which the present invention is based is to provide a combined web-fed printing machine as indicated in the beginning, which, on the one hand, allows an easily executable perfect register correction and printing-length correction and in which, on the other hand, the difficulties associated with the production of cylinders with a continuous surface do not arise.

According to the invention, this object is achieved in that all the printing units are of a design similar to that on sheet-fed printing machines and the respective cylinders forming the printing nip each have a plurality of sectors separated by cylinder pits, in that, as seen in the transport direction, the transport device possesses, in front of the printing nip of each printing unit, a first paper-web store and a following intermittently controllable first draw-roller unit and, after the printing nip of each printing unit, an intermittently controllable second draw-roller unit and a following second paper-web store, all the draw-roller units mentioned being controllable for the forward and backward movement of the web by means of individually regulated drives, in that these draw-roller units are at the same time devices for register correction and for printing-length correction, and in that at least one of the continuously driven draw-roller arrangements mentioned is installed respectively in front of the first paper-web store of the first printing unit, between the second paper-web store of the first printing unit and the first paper-web store of the second printing unit, and behind the second paper-web store of the second printing unit, in such a way that the paper web is transported uniformly not only in front of the first paper-web store of the first printing unit and behind the second paper-web store of the second printing unit, but also between the two printing units, within the portion limited by the respective paper-web stores.

Thus, in the combined web-fed printing machine according to the invention, all the advantages known from sheet-fed printing machines can be utilized and, furthermore, individual register corrections carried out on each printing unit, so that there is no adding together of register errors. The advantages are dealt with in more detail once again at the end of the description of FIGS. 1 to 3.

Preferably, as indicated in claim 2 or 3, the web-fed printing machine according to the invention has an indirectly printing printing unit which is appropriately the first printing unit, and at least one, especially two intaglio printing units; their construction with sector-shaped impression and plate cylinders is highly advantageous, as already explained earlier. The sequence of the printing units can also be selected as claimed in claim 4.

The draw-roller groups known from DE-C-3,135,696 each consist of a draw roller and of a pressure roller pressing the paper web against this. However, a draw-roller group of this type is unfavorable for the pilgrim-step mode of operation, since the masses of two rollers have to be braked and accelerated very quickly, and moreover, to prevent the paper web from sliding between the rollers the two rollers have to be pressed against one another with a high force. To avoid these disadvantages, the web-fed printing machine according to the invention preferably has a draw-roller unit in the form of only one suction roller, as described in claim 5; expedient embodiments of this suction roller are described in the following dependent claims.

Expedient designs of the cylinders of a printing unit which form the printing nip emerge from claims 12 and 13. The regulating and control system for the two draw-roller units of a printing unit is preferably designed as indicated in claims 14 and 15.

BRIEF DESCRIPTION OF THE DRAWINGS

The invention is explained in more detail by means of an exemplary embodiment with reference to the drawings. In these.

DESCRIPTION OF THE PREFERRED EMBODIMENTS

First the general construction of the combined printing machine with the three printing units A, B and C and then the transport device for the paper web and the run of the latter are described below.

Figure 1:
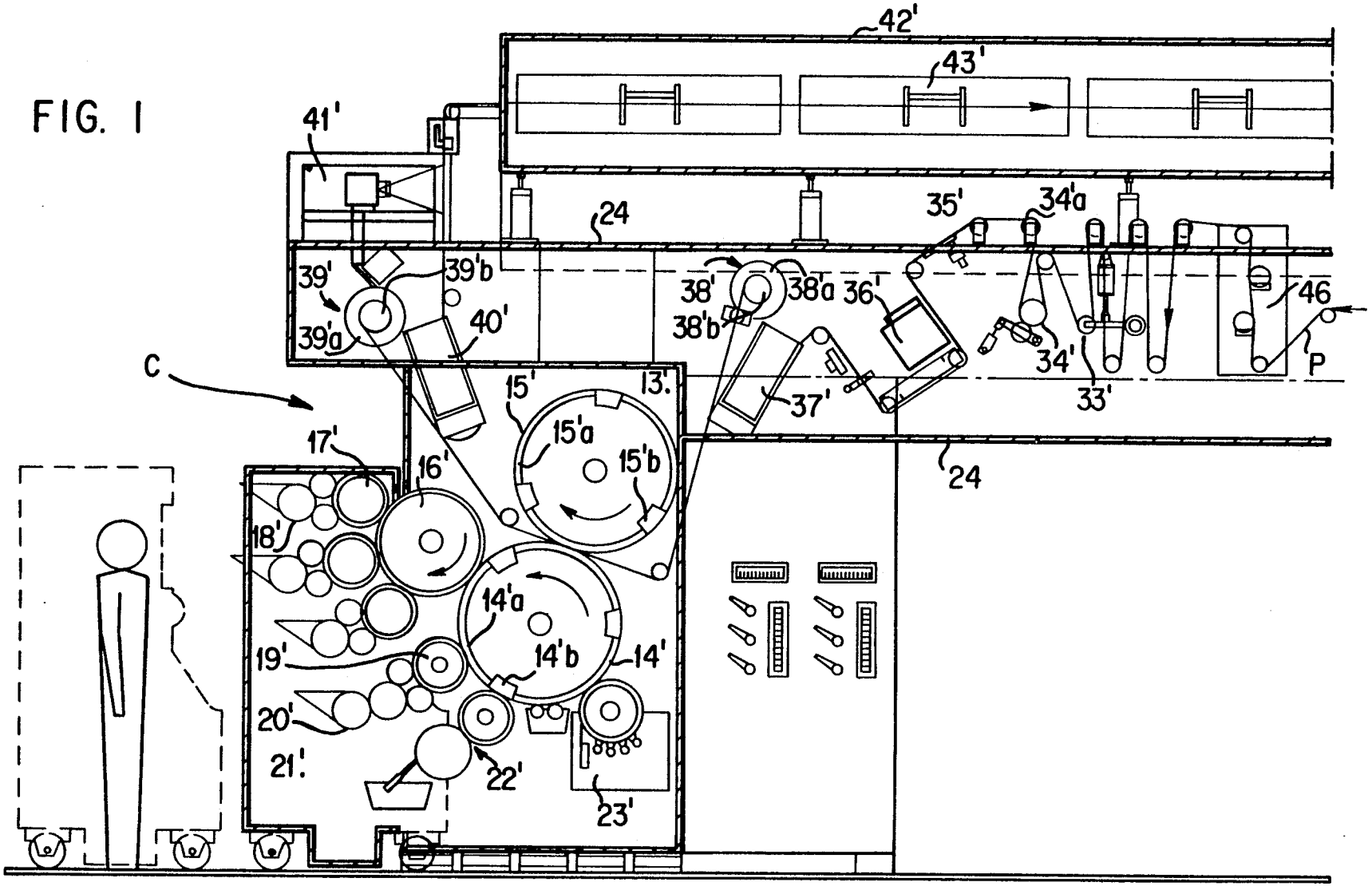
FIGS. 1 to 3, placed next to one another from left to right, show a combined web-fed printing machine according to the invention, FIG. 2 illustrating the first indirectly printing printing unit and FIGS. 3 and 1 illustrating two following intaglio printing units.
Figure 2:
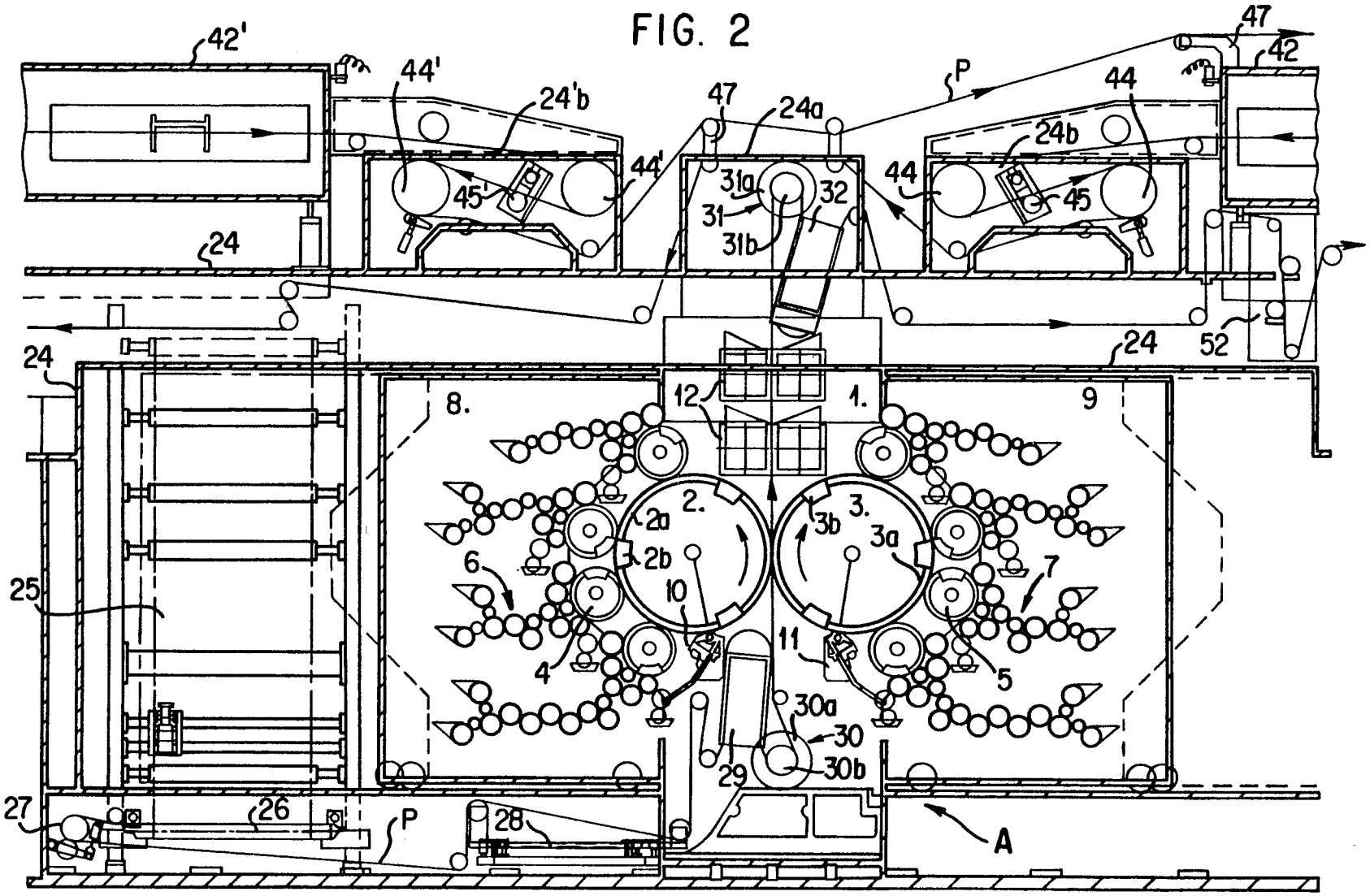
Figure 3:
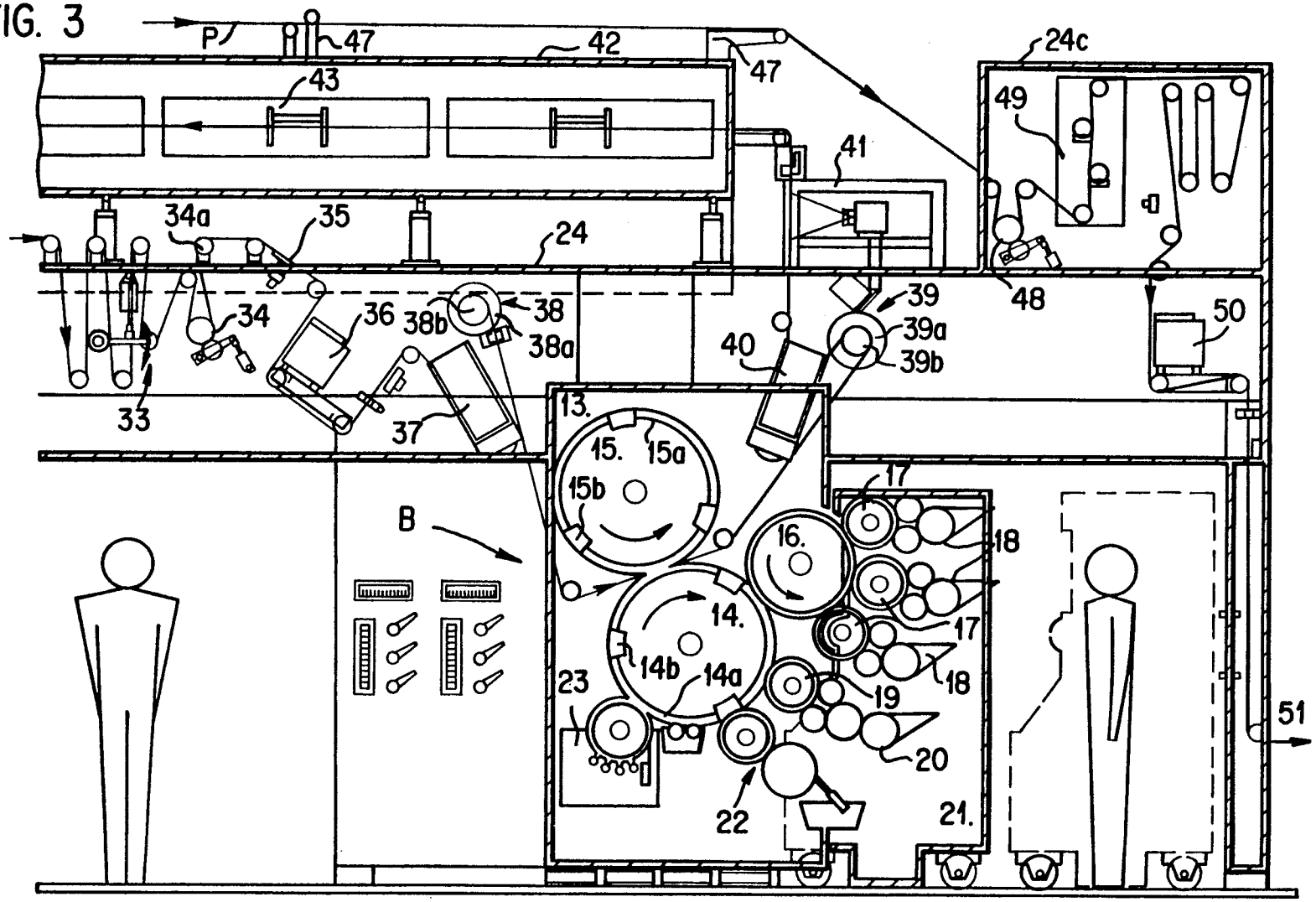

The combined printing machine illustrated in FIGS. 1 to 3 has three printing units A, B and C, through which the web P to be printed runs in succession in the direction of the arrows. The first printing operation takes place in the indirectly printing printing unit A (FIG. 2) which is located in the middle of the machine and which, in the example under consideration, is a multicolor offset printing unit working in recto-verso printing. Here, the two sides of the web are each provided simultaneously with a multicolor offset print. Subsequently, the web runs through an intaglio printing unit B (FIG. 3) which is located at the right-hand end of the machine and in which one side of the web receives a multicolor intaglio print. Finally, the web runs through a further intaglio printing unit C which is located at the left-hand end of the machine and in which the other side of the web receives a multicolor intaglio print.

The printing unit A designed as an offset printing unit has two interacting blanket cylinders 2 and 3 mounted next to one another in a stand 1 and rotating in the direction of the curved arrows, each with three sectors, on each of which a blanket 2*a*, 3*a* is clamped. The sectors are separated by cylinder pits 2*b*, 3*b*, in which the means for clamping the blankets are accommodated. This offset printing machine is therefore of a design similar to that of a sheet-fed printing machine.

Each blanket cylinder 2 and 3 interacts with four plate cylinders 4, 5 each which are mounted in the stand 1 and which carry offset printing plates and are inked in different colors by corresponding inking units 6, 7. In the example under consideration, the uppermost inking unit has a single ink fountain on each side, whilst the remaining three inking units are equipped with a double ink fountain on each side. As shown by the dampening units indicated in FIG. 2 and assigned to each inking unit, the example under consideration relates to a wet offset printing machine which can also alternatively be operated as an indirect typographic printing unit or in a combination of the two processes. All the inking units 6 on one side are arranged in a removable inking-unit stand 8 and all the inking units 7 on the other side are arranged in a removable inking-unit stand 9. Moreover, installed on the circumference of the blanket cylinders 2 and 3 are automatic blanket-washing devices 10 and 11 which are shifted away from the blanket cylinders during the printing operation of the machine. Installed above the blanket cylinders 2 and 3 is a paper-drying device 12 which works by UV radiation and through which the freshly printed web runs.

The intaglio printing unit B (FIG. 3) has a plate cylinder 14 mounted in a stand 13 and an impression cylinder 15 interacting with this. This intaglio printing machine too is of a design similar to that of a sheet-fed printing machine, that is to say the plate cylinder 14 has sectors which are separated by cylinder pits **14*b* and on which three printing plates 14*a* are clamped by means of devices installed in the cylinder pits 14*b*. The impression cylinder 15 correspondingly has three sectors which are separated by cylinder pits 15*b* and on which printing coverings 15*a* are clamped. The plate cylinder 14 is inked on the one hand indirectly by a collecting and inking cylinder 16 and on the other hand directly by a stencil roller 19. In the example under consideration, the collecting and inking cylinder 16 interacts with three color selector cylinders 17 which are each inked by an inking unit 18. These color selector cylinders 17 are designed in the manner of stencil rollers and have relief-like zones, the contours of which correspond to the outlines of the regions to be printed with the particular color. The different color regions arising from all three color selector cylinders 17 are collected on the collecting and inking cylinder 16 and transferred to the printing plates 14*a*. The stencil roller 19, located behind the collecting and inking cylinder 16, as seen in the direction of rotation of the plate cylinder 14, is inked by an inking unit 20. Behind this stencil roller 19 are installed a prewiping device 22 engaging on the plate cylinder 14 and after it a wiping device 23. The cylinders 14, 15 and 16, the direction of rotation of which is indicated by curved arrows, the stencil roller 19, the prewiping device 22 and the wiping device 23 are installed in a machine stand 13, whilst the color selector cylinders 17 with their inking units 18 and the inking unit 20 are arranged in a removable inking-unit stand 21**, the shifted-away position of which is represented by broken lines.

The above-explained intaglio printing unit B is known and is described in EP-B-091,709 of the same applicant.

The web P printed on one side in the printing unit B is then printed on the other side with a multi-color intaglio printing image in the third printing unit C which is likewise an intaglio printing unit constructed as a mirror image to the printing unit B. Because of the identical construction of the printing units B and C, the parts of the printing unit C are designated by the same reference symbols, but with a prime mark, namely 13' to 23', so that there is no need for a description of the printing unit C.

All three printing units A, B and C and the below-described transport device for the web P are accommodated in a common main stand 24 of the machine. The transport device and the run of the web P are described hereafter, only those parts essential for an understanding of the invention being discussed.

The web P is unwound from a paper roll (not shown) and passes via a web feed device 25 (FIG. 2) and a turning rod 26 into a first draw-roller arrangement 27 consisting of a draw roller, round which the web is looped, and of a pressure roller which presses the web against the draw roller. This draw-roller arrangement 27 and the draw-roller arrangements 34 (FIG. 3) 34' (FIG. 1) and 48 (FIG. 3) mentioned later are preferably driven uniformly. Via a device 28 for the lateral alignment of the web, the latter then passes over deflecting rollers into a first paper-web store 29 which, in the example under consideration, works with a vacuum chamber. A paper-web store of this type is known and is controlled in such a way that, between the draw-roller arrangement 27 and the entrance of the paper-web store 29, the paper web P is constantly kept taut at a preset-table value by means of a predetermined air under pressure.

At the exit of the paper-web store 29, the web runs through a draw-roller unit 30 which is individually controlled intermittently for the forward and backward movement of the web. In the example under consideration, this individually controllable draw-roller unit 30 has a single suction roller **30*b* as a draw roller, the design of which is described in more detail later and which is controlled by an individual regulated drive 30*a* in the form of an electronically controlled motor. The web coming out of the paper-web store 29 loops round this suction roller from below over approximately 180° and then, guided by a deflecting roller, runs through the printing nip formed by the two blanket cylinders 2 and 3 and thereafter through the drying device 12 and then loops from above round a suction roller 31*b* belonging to a second draw-roller unit 31, once again over approximately 180°. This draw-roller unit 31 installed in a stand part 24*a* above the main stand 24 is designed in the same way as the draw-roller unit 30, is controllable intermittently for the forward and backward movement of the web and is likewise moved by an individually regulated drive 31*a* in the form of an electronically controlled motor. After the draw-roller unit 31, the web passes through a second paper-web store 32 which is constructed and is controllable in exactly the same way as the paper-web store 29. Subsequently, the web is guided via a plurality of deflecting rollers, to the right in the representation according to FIGS. 2 and 3, through a dampening device 52 acting on both web sides and a device 33 matching the paper travel to the desired repeat length, to a further draw-roller arrangement 34 which is constructed in exactly the same way as the draw-roller arrangement 27 and which has a uniformly driven draw roller and a pressure roller pressing the web against this (FIG. 3). The roller 34*a*, over which the web then runs, measures the web tension and causes the control of the device 33 and of the draw-roller arrangement 34**.

The web P then runs further via a device 35 measuring its moisture and temperature, via a device 36 for the lateral alignment of the web and via a deflecting roller into a first paper-web store 37 which belongs to the second printing unit B and which is constructed and is controllable in the same way as the abovementioned paper-web stores. In the region between the paper-web stores 32 and 37 the paper web is kept constantly tensioned with an adjustable force and is moved through the draw-roller arrangement 34 at a uniform speed.

After coming out of the paper-web store 37, the web loops from above, over approximately 180°, round the suction roller 38*b* of a draw-roller unit 38 likewise controlled intermittently, runs, guided by deflecting rollers, through the printing nip between the plate cylinder 14 and the impression cylinder 15 of the intaglio printing unit B, thereafter loops, over approximately 180°, round the suction roller 39*b* of a likewise intermittently controlled draw-roller unit 39 and then enters the second paper-web store 40 assigned to the printing unit B. The draw-roller units 38 and 39 are of the same design as those described above and are each controlled by an independent regulated drive 38*a*, 39*a* for the forward and backward movement of the web portion running between the paper web stores 37 and 40. During the looping round of the suction roller 39*b*,the side of the web not printed in the printing unit B bears against this roller.

After coming out of the paper-web store 40, the web passes through a video monitoring device 41 which scans the printing images, and then, after being deflected by a deflecting roller runs through a drying chamber 42 mounted on the main stand 24 and having a plurality of hot-air dryers 43. The web comes out on the side of the drying chamber 42 on the left in FIG. 2 and passes into a stand part 24*b* which is mounted on the main stand 24 and in which it loops round two driven cooling rollers 44 and between them runs through a dampening device 45. The web is then guided via deflecting rollers above the stand part 24*a* and further, to the left in the representation according to FIGS. 2 and 1, as far as a dampening device 46 which dampens the two sides of the web.

The following stations of the transport device, including the run of the web through the printing nip between the plate cylinder 14' and the impression cylinder 15' of the intaglio printing unit C, correspond to the stations 33 to 45 already described and to the run of the web through the printing unit B. These stations following the dampening device 46, which are designated by the same corresponding reference symbols, but bearing a prime mark, namely 33' to 45', are therefore not described in detail. It will merely be pointed out that, once again, a first paper-web store 37' and the intermittently controlled suction roller 38*b'* of a first draw-roller unit 38' are installed in front of the printing nip of the printing unit C and the intermittently controlled suction roller 39*b* ' of a second draw-roller unit 39' and a second paper-web store 40' after the printing nip, so that the respective portion of the web in the printing unit C can once again be moved respectively to and fro by means of an independent regulated drive 38'*a* and 39'*a* each. The side of the web not printed in the printing unit C is looped round the suction roller 39*b'*.

After the web P has left the stand part 24*b'* with the cooling rollers 44' and the dampening device 45' (FIG. 2), it runs to the right in the representation according to FIGS. 2 and 3 and is guided, by deflecting rollers mounted on stays 47 located on the stand part 24*a* and on the drying chamber 42, into a stand part 24*c*, in which it runs through between the uniformly driven draw roller and the pressure roller of a further draw-roller arrangement 48 and passes into a further dampening device 49. The web, guided by deflecting rollers, then travels past a further video monitoring unit 50 to the exit 51 of the machine, from which it is fed to further control and processing stations, especially cutting stations.

The transport device described is therefore designed in such a way that the paper web is moved continuously from its paper roll as far as the first paper-web store 29 of the printing unit A, between the second paper-web store 32 of the printing unit A and the first paper-web store 37 of the printing unit B, between the second paper-web store 40 of the printing unit B and the first paper-web store 37' of the printing unit C and behind the second paper-web store 40' of the printing unit C, whilst the web portions passing through the printing nips of all three printing units A, B and C, between the first and the second paper-web store of each printing unit respectively, are moved to and fro in a controlled way in the so-called pilgrim-step mode of operation. It will briefly be explained as regards the printing unit A (FIG. 2):

As long as the blankets 2*a* and 3*a* of the blanket cylinders 2 and 3 act on the web P and clamp this during the printing, the web is transported by the two rotating blanket cylinders 2 and 3 and the suction rollers 30*b* and 31*b* at the printing-nip speed. But whenever two cylinder pits 2*b* and 3*b* are located opposite one another and release the web for a correspondingly short period of time, then the draw-roller units 30 and 31 alone take over the further transport of the web. During this short phase, the paper web between the two blanket cylinders 2 and 3 is braked within fractions of a second from the normal printing-nip speed to a stop, is then accelerated in the backward direction, is thereafter braked to a stop once again, and finally is accelerated in the forward direction up to the printing-nip speed, whereupon the further transport takes place once more at the printing-nip speed by means of the two blanket cylinders 2 and 3 and the suction rollers 30*b* and 31*b*, as soon as the blankets of the two blanket cylinders following the cylinder pits mentioned again clamp the web on both sides for the subsequent printing. The pilgrim-step movement described is controlled in such a way that, in order to save paper, the printing images transferred successively onto the paper web follow one another at the predetermined close interval, and in a way known per se makes it possible to change the printing format continuously, for example between the repeat lengths of 605 mm and 685 mm, measured in the transport direction, without the cylinders having to be changed. It is sufficient suitably to adjust the lengths by which the web is moved backwards and forwards relative to the circumference of the moved blanket cylinders 2 and 3 during the pilgrim-step mode, and to program the regulation of the drives 30*a* and 31*a* accordingly. Moreover, the draw-roller units 30, 31 take over the register control and printing-length control, as explained in detail in relation to FIG. 11.

Figure 11:
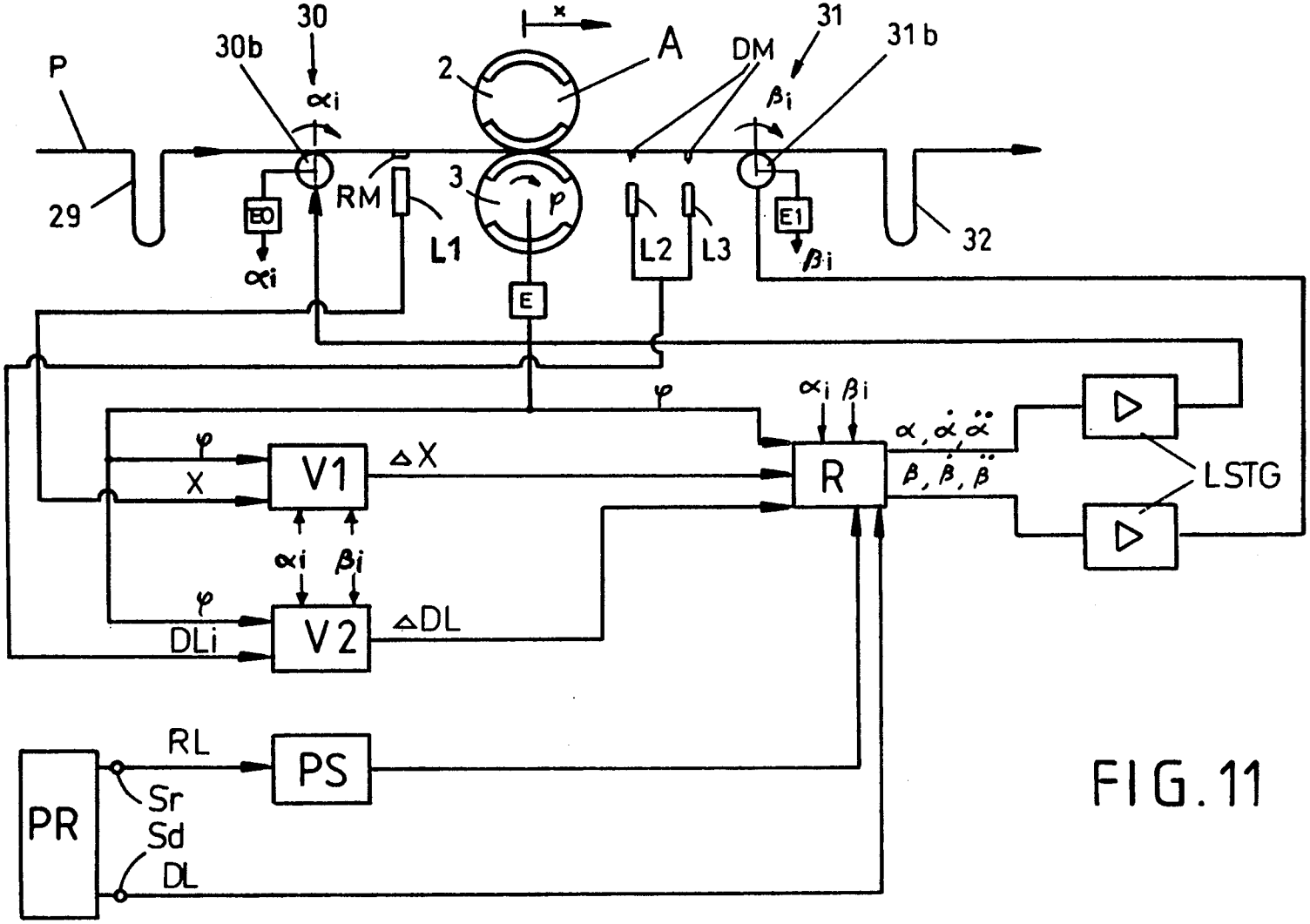
FIG. 11 shows a signal flow diagram of the regulating and control system for the two draw-roller units of a printing unit.

FIG. 11 shows the signal flow diagram of the regulating and control system for the two draw-roller units of a printing unit, specifically, for example, of the printing unit A with its two blanket cylinders 2 and 3 as printing-unit cylinders and the draw-roller units 30 and 31. At the top, FIG. 11 shows diagrammatically the path of the paper web P through the paper-web store 29, over the suction roller 30*b*, through the printing nip between the two blanket cylinders 2 and 3, over the suction roller 31*b* and through the paper-web store 32. The suction roller 30*b* is equipped with an encoder $E_0$ as an actual-value transmitter which measures the actual position value $\alpha i$, indicated by an arrow, of the suction roller 30*b*, that is to say its angular position. The suction roller 31*b* is likewise equipped with an encoder $E_1$ as an actual-value transmitter which measures the actual position value $\beta i$ of this suction roller. One of the printing-unit cylinders, in the example under consideration the blanket cylinder 3, is equipped with an encoder E as a desired-value transmitter which measures the rotary angle $\Psi$ of the blanket cylinder 3 and therefore of course also of the blanket cylinder 2 driven synchronously with and oppositely to the latter. Installed in front of the printing nip is a reader L1 for reading register marks RM which are provided on the paper web P, for example in the form of watermarks, and the position of which is designated by x. Located after the printing nip are two readers L2 and L3 reading printing marks DM which have been applied at the printing start and at the printing end of the preceding print in the printing unit A and the distance between which represents the actual value of the printing length DLI.

According to FIG. 11, the regulating and control system has a pilgrim-step generator PS, a controller R, for example in the form of a process computer, connected to its output, and two comparators V1 and V2, each equipped with four inputs. The comparator V1 is connected on the input side to the three encoders E, Eo and E1 and to the reader L1 and at its output to the controller R. The comparator V2 is likewise connected on the input side to the three encoders E, E0 and E1 and to the readers L2, L3 and at its output to the controller R. The controller R, which is also connected to the three encoders E, EO and E1 on the input side, has two outputs connected to one power output stage LSTG each, of which one controls the draw-roller unit 30 and the other the draw-roller unit 31.

The system described works as follows:

At the respective inputs Sr and Sd, the desired mean repeat length RL is entered in the pilgrim-step generator PS and the desired printing length DL is entered in the controller R, preferably by means of an overriding process computer PR. By repeat length is meant, as is known, the distance from the printing start to the printing end of successive prints. The pilgrim-step generator PS calculates the pilgrim step necessary for this repeat length RL. The draw-roller units 30, 31 are regulated as a function of the rotary angle $\Psi$ or of the rotational speed of the blank cylinders 2 and 3, with register and printing-length corrections being taken into account.

The comparator V1 compares the rotary angle $\Psi$ of the blanket cylinders 2, 3 and the position x of the read-off register marks RM and transmits a possible deviation $\Delta x$ from the ideal position x of the register mark RM to the controller R. The comparator V2 compares the rotary angle $\Psi$ of the blanket cylinders 2, 3 and the actual value of the printing length DLi read off by the readers L2, L3 and transmits a possible deviation $\Delta DL$ from the desired value of the printing length DL to the controller R.

As a function of the rotary angle $\Psi$ of the blanket cylinders 2, 3, of the actual position values $\alpha i$, $\beta i$ of the suction rollers **30*b* and 31*b* and of the deviations $\alpha x$ and $\alpha DL$, the controller R presets the desired values $\alpha$, $\dot{\alpha}$ and $\alpha$ and $\beta$, $\dot{\beta}$ and $\beta$, that is to say respectively the desired position value, speed value and acceleration value of the suction rollers 30*b* and 31*b*, as control values for the respective power output stages LSTG which ensure a corresponding control of these suction rollers. Thus, the desired position value of the paper web at the end of the pilgrim-step mode is preset in such a way that a possible deviation $\Delta x$ from the ideal value of the repeat length RL is compensated. Furthermore, the stretch of the paper web in front of the printing unit during the pilgrim-step mode is controlled by an appropriate regulation of the web tension, in such a way that a possible deviation $\Delta DL$ is compensated and therefore the desired printing length DL is maintained exactly. The respective stretch of the paper web is obtained from the measured angular positions and angular speeds of the suction rollers 30*b* and 31*b*** and can be varied by means of temporarily different angular speeds of the two suction rollers.

After the pilgrim-step mode, during the printing phase the two suction rollers **30*b* and 31*b* are operated with a circumferential speed synchronous with the circumferential speed of the blanket cylinders 2, 3**, the set web stretch at the same time being maintained.

If the paper web P running into the first printing unit of the printing machine, in the example under consideration the printing unit A, has no previously applied register marks or no watermarks functioning as register marks, than of course the reader L1 and the comparator V1 are inoperative. The comparator V2 for the printing length functions as described above. By entering the desired value of the repeat length RL at the input Sr, the desired position value of the paper web at the end of the pilgrim-step mode is preset, taking into account the printing mark DM marking the printing start, in such a way that this repeat length RL is maintained exactly by an appropriate calculation of the control quantities for the draw-roller units 30, 31. In this case, therefore, one of the printing marks DM generated in the printing unit A also has the function of a register mark, in relation to which the repeat length, that is to say the register therefore, is controlled during the immediately following printing in the printing unit A.

In all cases, the printing marks applied in the first printing unit and marking the printing start serve in the second printing unit and in the following printing units, in the example under consideration in the printing units B and C, as register marks, of which the position x read off in front of the printing nip is compared, in the comparator V1, with the rotary angle $\Psi$ of the cylinders of the respective printing unit, in order to determine and correct a possible deviation $\Delta x$.

Instead of providing printing marks which are printed by the printing plates onto the margin surrounding the printing images and later cut off, sufficient contrasts between the limitation of the printing image, at the front in the transport direction, and the white margin and between the rear printing-image limitation and the white margin can also be used to generate printing-mark signals which serve for regulating the printing length and repeat length.

The suction rollers **38*b* and 39*b* in the intaglio printing unit B and the suction rollers 38*b*' and 39*b*' in the intaglio printing unit C are controlled by control and regulating systems of the same design as that described with reference to FIG. 11. In these, therefore, the draw-roller units 38, 39 and 38', 39' additionally likewise perform the function of a register and printing-length correction, so that in the intaglio printing units B and C the prints are carried out in-register in relation to the prints previously made. The regulation is carried out as a function of the printing marks applied in the first printing unit A and functioning as register marks and as a function of the printing marks generated in the respective printing unit B or C. In these cases, the plate cylinder 14, 14' or the impression cylinder 15, 15'** is equipped with an encoder E as a desired-value transmitter.

Instead of encoders, angular-position transmitters of another known type can also be used.

The overriding process computer PR preferably provided for the machine as a whole coordinates and optimizes the regulating and control systems of each of the printing units A, B and C.

In a further embodiment of the inventive idea, this makes it possible, by the continuous computer-controlled change of the repeat length, to obtain an identical or different or constantly somewhat changing paper throughput per unit time through the three different printing units A, B, C of the exemplary embodiment. The machine can thus react immediately to all possible influences disturbing the printing operation of a web-fed machine, without time-consuming and costly variations of the relevant impression-cylinder and plate-cylinder diameters. Problems, such as web shortening as a result of drying, web lengthening as a result of redampening, different printing lengths arising from a varying web tension or greatly differing pressing forces in gravure, intaglio and offset printing, different paper qualities, watermarks jumping from roll to roll, etc., are overcome as a result of the decoupling according to the invention of the various printing units by means of computer-controlled independent pilgrim-step drives for the paper web.

It is thereby also possible in an advantageous way, in each of the three printing units A, B, C, if necessary, to work not only with different repeat lengths, but also, during the particular printing operation, with different paper-web tensions for the purpose of correcting the printing length.

There is no need for the hitherto conventional special devices for register correction and printing-length correction in combined printing machines, because their function is performed by the draw-roller units.

A further advantage is that the general register problems existing hitherto, which arose especially because tolerances and register errors were added together during the successive printing operations, are avoided. Such register errors also depend, above all, on the properties and the behavior of the paper web which undergoes variations as a result of the drying and dampening phases. However, these are compensated completely by means of the regulated pilgrim-step mode in the printing units B and C. In actual fact, all the register errors which previously occurred in a printing unit can be eliminated completely by means of the pilgrim-step mode, so that, where the register control is concerned, each printing operation begins as it were anew.

Also overcome are the disadvantages of previous combined printing machines with a continuous uniform paper-web transport, in which the coordination of the conveying behavior between an offset printing machine and an intaglio printing machine and the exact matching of the diameters of the offset blanket cylinders and plate cylinders of the intaglio printing machine are very difficult.

Furthermore, in the intaglio printing units to be used, the successfully proven and long-known methods of fastening, clamping and aligning individual printing plates on the plate cylinder can be utilized, that is to say the long-known advantages of an intaglio printing machine designed as a sheet-fed printing machine, thereby doing away with all the complications associated with intaglio printing machines intended for web-fed printing and with their forme cylinders. Moreover, as in sheet-fed printing, the impression cylinder can be equipped with known and proven printing coverings of long service life, so that the clearly perceptible embossing characteristic of intaglio printing is achieved.

Figure 4:
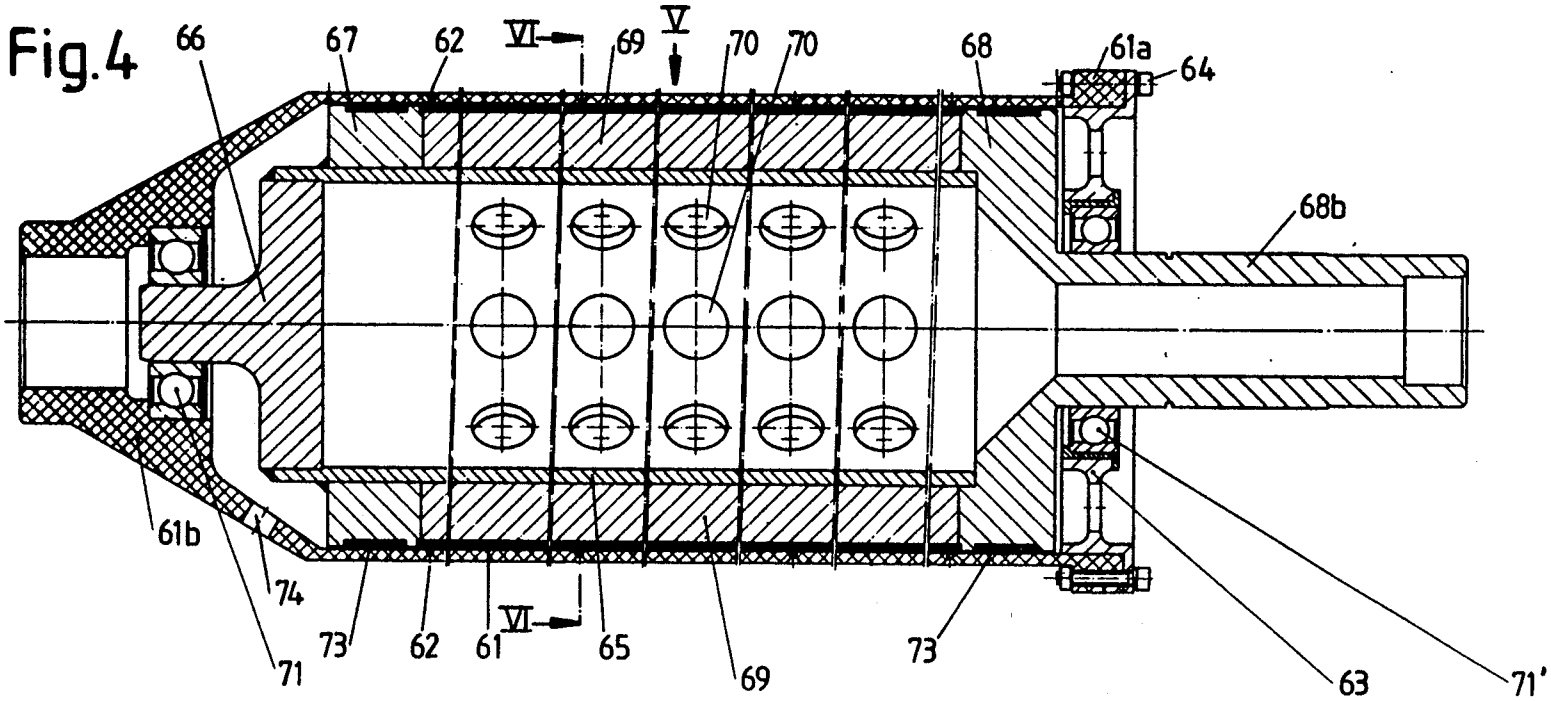
FIG. 4 shows an axial section through a suction roller of a draw-roller unit along the line IV—IV of FIG. 6.
Figure 5:
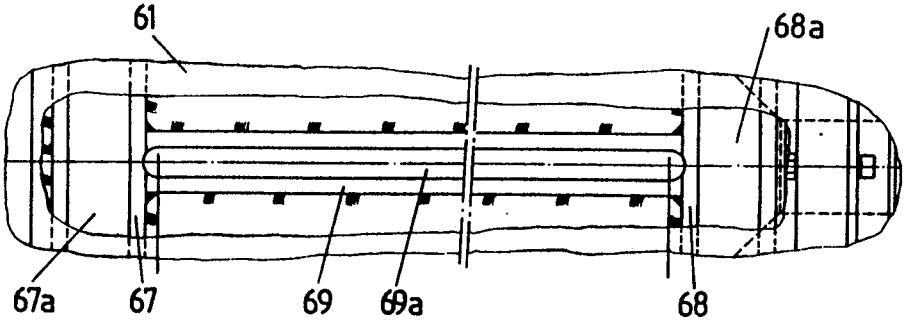
FIG. 5 shows a partially sectional part view in the direction of the arrow V according to FIG. 4.
Figure 6:
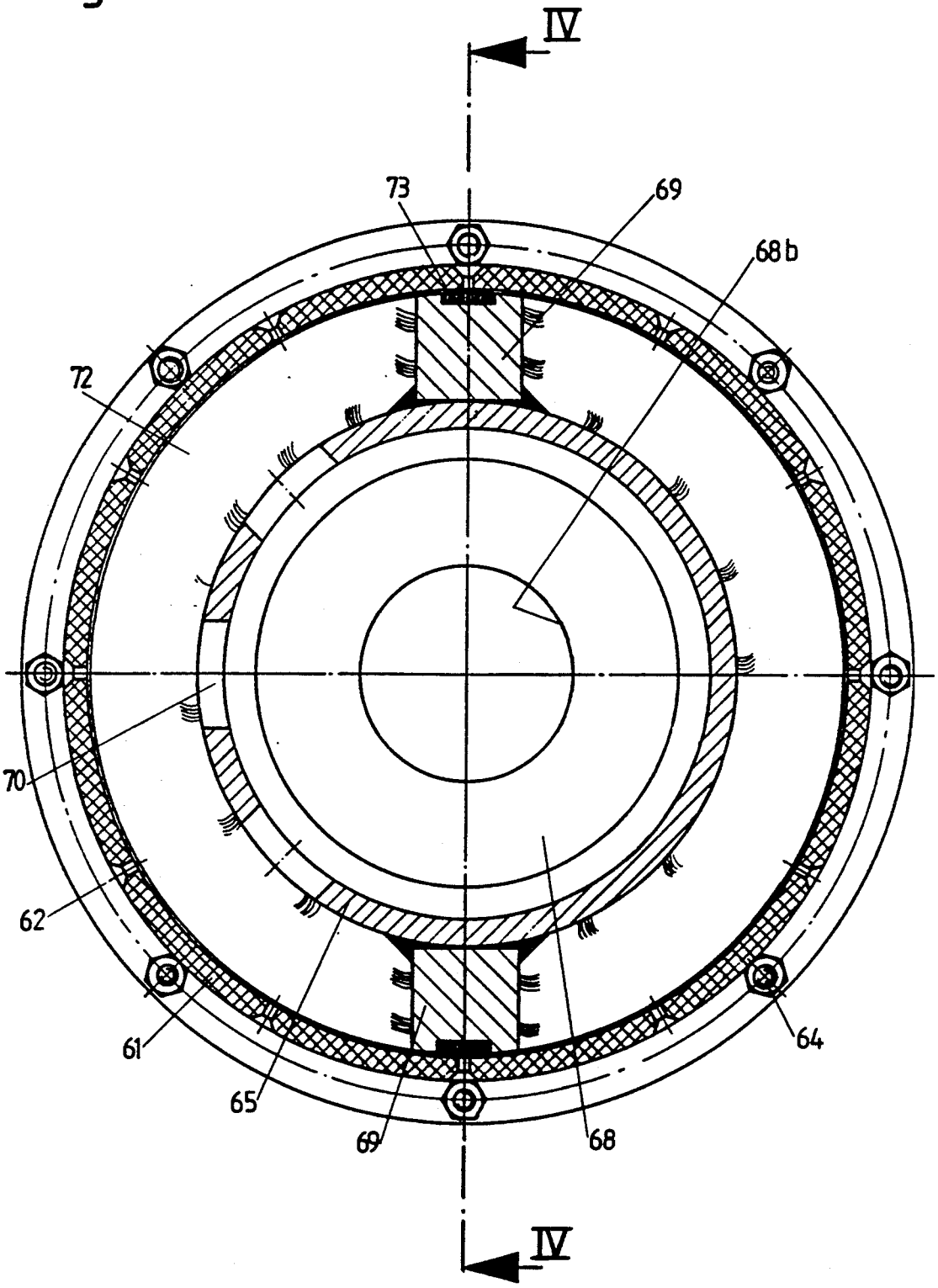
FIG. 6 shows a radial section through the suction roller along the line VI—VI of FIG. 4 on an enlarged scale.
Figure 7:
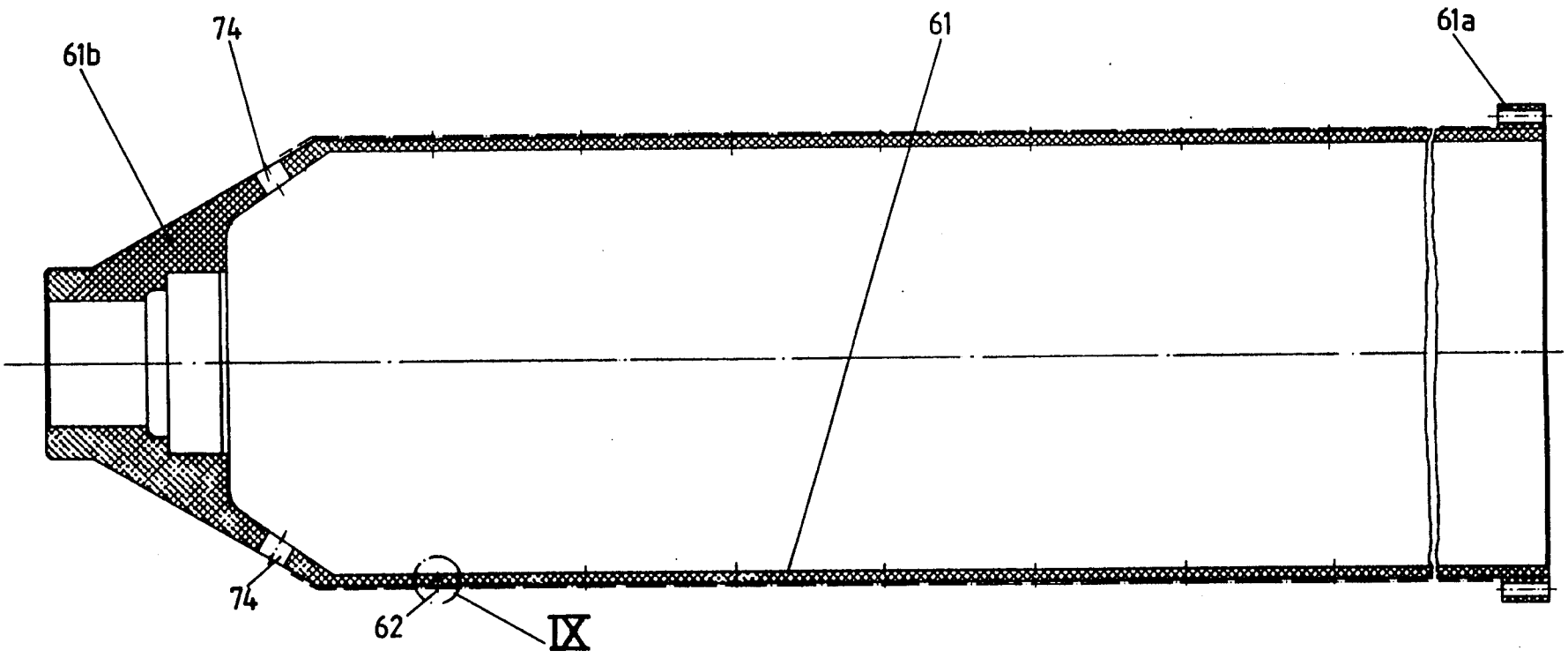
FIG. 7 shows a section through the suction-roller casing.

FIGS. 4 to 9 illustrate a preferred embodiment of the suction roller 30*b*, 31*b*, 38*b*, 39*b*, 38*b*', 39*b*' of a draw-roller unit 30, 31, 38, 39, 38', 39'. According to FIG. 4, the rotating part of this suction roller consists of a roller casing 61 which is produced from a lightweight carbon-fiber-reinforced plastic (CFK), particularly from plastic-impregnated carbon fibers, and which therefore has a relatively low rotational inertia. Since, in the pilgrim-step mode, the suction roller repeatedly has to be sharply braked and accelerated rhythmically in fractions of seconds, as low a moment of inertia of the rotating part as possible is desirable. FIG. 7 shows the roller casing 61 as an individual part, and in a typical incidence it has a total axial length of approximately 100 cm and a diameter of approximately 15 cm. As the interruptions indicate, the representations according to FIGS. 4 and 7 show the suction roller axially reduced.

An outer annular flange 61*a* is formed on the cylinder casing 61 at one end, and the other end is tapered conically to form a connecting flange 61*b*. On its circumference, the roller casing 61 is equipped with a plurality of suction ports 62, the distribution of which is explained further later. A flanged part 63, preferably made of light metal, is fastened to the annular flange 61*a* by means of screws 64.

The roller casing 61 is rotatable about a stationary hollow roller core 65 made preferably of metal. Fastened to the roller core 65 at the end facing the connecting flange 61*b* of the roller casing 63 is a metal bearing journal 66, the base of which sealingly closes the interior of the roller core 65. Fastened to the circumference of the roller core 65 at a specific angular distance from one another in the example under consideration at the angular distance of 180°, are two radial partition walls 69 which preferably consist of metal and which enclose a suction chamber 72 between them, as shown especially in FIG. 6. Fastened to the circumference of the roller core 65 on the two axial sides of the partition walls 69 are annular walls 67 and 68 which likewise preferably consist of metal and which close the suction chamber 72 on its axial sides. The annular wall 68 at that end of the roller core 65 facing the flanged part 63 is extended axially by a projecting connecting piece 68*b* which serves for fastening the stationary part of the suction roller to the machine stand and for connection to a vacuum source. Within the suction chamber 72, the circumferential wall of the roller core 65 is equipped with relatively large passage orifices 70. All the parts 66, 67, 68, 69 fastened to the roller core 65 are welded on in the example under consideration.

As shown in FIG. 4, the roller casing 61 is mounted rotatably at its one end with its flanged part 63 on the connection piece 68*b* by means of a bearing 71', designed as a ball bearing in the example under consideration, and at its other end with its connecting flange on the bearing journal 66 of the roller core 65 by means of a bearing 71 likewise designed as a ball bearing. At the same time, the arrangement is such that the gaps between the inner circumference of the roller casing 61 and the radially outer ends of the partition walls 69 and the outer circumference of the annular walls 67 and 68 are sealed off at least approximately against a passage of air. In the example under consideration, this is carried out by means of a suitable sealing material 73 which is inserted into axis-parallel depressions 69*a* of the radially outer ends of the partition walls 69 and into annular depressions 67*a* and 68*a* (FIG. 5) on the circumference of the annular walls 67 and 68. This sealing material 73 can especially be, for example, a self-adhesive brush. However, the arrangement can also be such that only a very small gap, without the insertion of any particular sealing material, is provided between the inner circumference of the roller casing 61 and the partition walls 69 and the annular walls 67 and 68. Such narrow gaps offer such high resistance to a passage of air that these gaps have sufficient sealing to maintain the necessary vacuum within the suction chamber 72.

In the assembled state, the connection piece 68*b* is connected constantly to a vacuum source, so that there is maintained inside the roller core 65 by means of the orifices 70, in the suction chamber 72 and consequently at the suction ports 62 opening respectively into the suction chamber 72 a sufficiently high vacuum, by means of which the paper web looping through 180° round the suction roller in the region of the suction chamber 72 is pressed against the outer circumference of the roller casing 61, that is to say is held by strong suction. A suitable surface treatment of the roller casing 61, the surface of which is preferably nickel-plated and plasma-coated, with the result that this surface becomes impact-resistant and abrasion-resistant and acquired some roughness, ensures that, even at the high accelerations of the suction roller occurring in the pilgrim-step mode, there is no slip between the latter and the paper web which therefore participates in all the movements of the suction roller.

Figure 8:
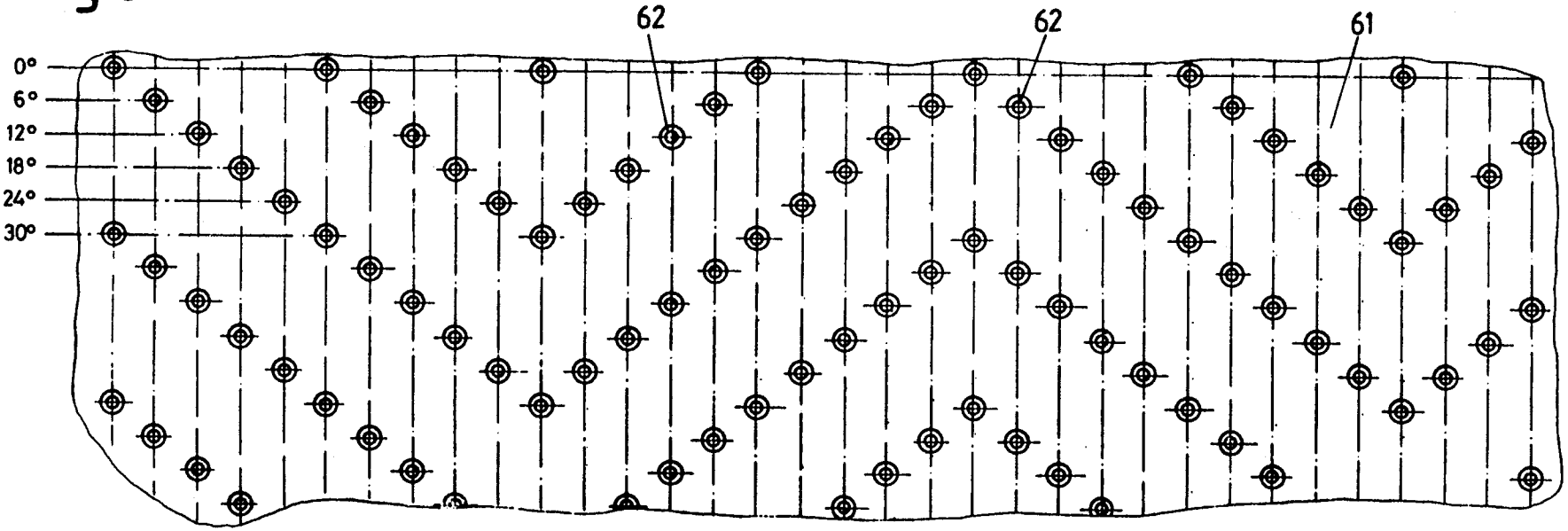
FIG. 8 shows a part of the suction-roller casing surface laid out in one plane, with the distribution of the suction ports.
Figure 9:
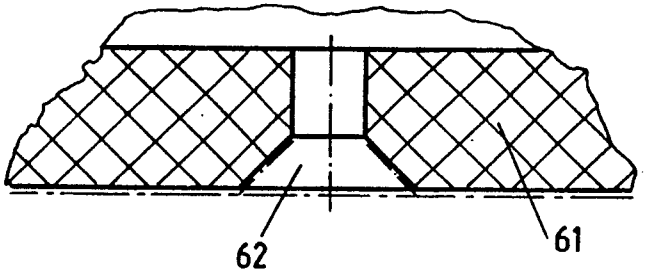
FIG. 9 shows an enlarged section through the suction-roller casing at the location IX according to FIG. 7, to illustrate the form of a suction port.

In order to obtain an easy and perfect release of the paper web from the suction roller at the end of looping, that is to say, therefore, at the end of the suction chamber 72, the suction ports 62 are distributed in a specific way shown in FIG. 8. In the representation according to FIG. 8 which shows part of the roller casing 61 laid out in one plane, the suction ports 62 are arranged in mutually parallel zigzag lines, that is to say respectively along helical portions extending in zigzag form on the roller casing 61. Thus, adjacent suction ports 62 are respectively arranged offset angularly towards each other and in parallel relative to the axial direction, the angular offset amounting respectively to 6° in the example under consideration. As seen in the circumferential direction, successive suction ports are distant from one another by an angle of 30°, and the distance between adjacent suction ports along a generatrix, that is to say parallel to the axis, amounts to approximately 5 cm in the example under consideration. This on the one hand ensures a successive cutoff of the vacuum at the end of looping, so that the web is released from the suction roller without difficulty, and on the other hand guarantees a good adhesion of the web on the suction roller in the entire looping region. The shape of the suction ports 62 is shown in the enlarged representation according to FIG. 9, according to which the inner region of this suction port consists of a cylindrical bore and the outer region consists of a conical widening.

A perfect balancing of the roller casing 61 is expediently achieved by making appropriately arranged and dimensioned bores 74 in the conical wall of the connection piece 61*b* (FIGS. 4 and 7) and, if appropriate, in the annular flange 61*a* between the orifices serving for the passage of the screws 64. If such bores are not sufficient, small studs can also be glued in on the other side to obtain a perfect balancing.

The roller casing 61 is pressed directly with its formed-on connecting flange 61*b* onto the shaft of the drive motor.

During the printing of small formats, these are, on the blanket cylinders of the offset printing unit and on the plate cylinder of the intaglio printing unit which then carries printing plates correspondingly shorter in the circumferential direction, at a larger distance from one another in the circumferential direction than during the printing of large formats. Accordingly, during the pilgrim-step mode, that is to say during the period of time when two cylinder pits of the interacting cylinders are located opposite one another, a larger web length has to be moved relative to the cylinders than during the printing of large formats. Consequently, to have sufficient time available between two successive prints for the pilgrim-step mode during the printing of small formats, the cylinders forming a printing nip are advantageously designed so that, with regard to an impression cylinder, the cylinder pits can be varied in their circumferential length by means of removable and exchangeable filler pieces of differing length and, as regards a blanket cylinder, by means of appropriately dimensioned blanket backings and can be matched to the particular format.

Figure 10:
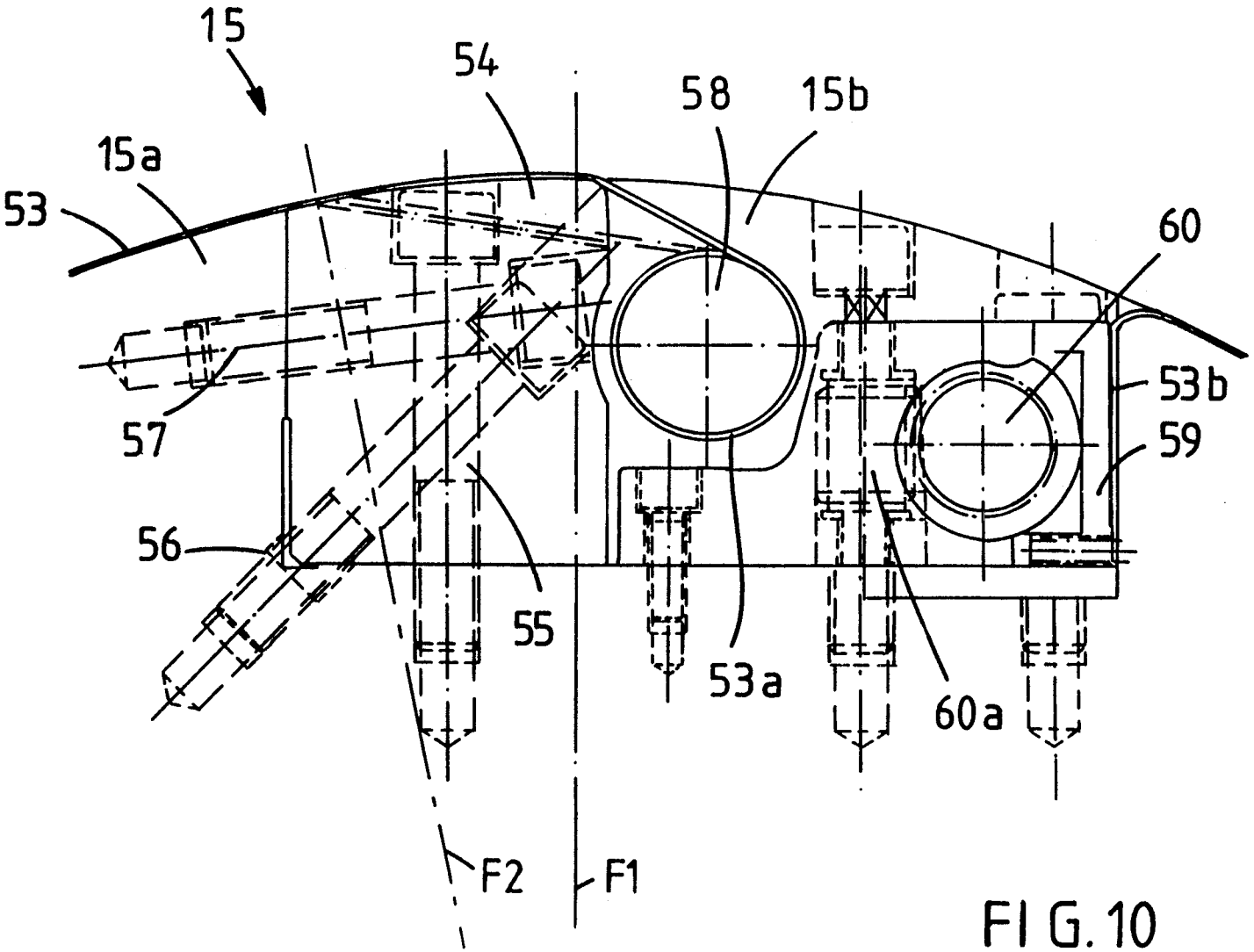
FIG. 10 shows a partial representation of an impression cylinder of one of the intaglio printing units in the region of the cylinder pit.

FIG. 10 illustrates the example of an impression cylinder of an intaglio printing unit, in the example under consideration of the impression cylinder 15, with a metal filler piece 54 inserted in the cylinder pit 15*b*. The printing covering 53 clamped on the cylinder sector 15*a* is fastened in a known way, by means of its end 53*a* engaging into the cylinder pit 15*b*, to a clamping shaft 58 by which it is clamped. The other end of the printing covering 53 is fastened in the adjacent cylinder pit in exactly the same way as the end 53*b* of the adjacent printing covering engaging into the cylinder pit 15*b*. This end 53*b* is clamped between the wall of the cylinder pit 15*b* on the right in FIG. 10 and a clamping piece 59 which is loaded by a rotatable cam 60. This cam 60 is equipped with a worm wheel, so that it can be tensioned by means of a worm 60*a*. The worm 60*a* can be rotated by means of a suitable spanner for the purpose of tightening or slackening the clamping piece 59.

The filler piece 54 bears with a plane side face against the cylinder-pit wall on the left according to FIG. 10 and with its plane bottom face on the bottom of the cylinder pit 15*b*. Its surface is curved and extends the cylindrical surface of the cylinder sector 15*a*. The right-hand edge at the top according to FIG. 10 is rounded, so that the printing covering 53 can be stretched over this edge. The filler piece 54 is held firmly and immovably by a plurality of fastening screws 55, 56, 57 of differing orientation. The fastening screws 55, 56, 57 which, in the example according to FIG. 10, are oriented vertically, obliquely and virtually parallel to the bottom of the cylinder pit 15*b* ensure that, despite the high pressure occurring during printing, the filler piece 54 does not change its position.

In the example under consideration, the impression cylinder 15 with the filler piece 54 is set up for the largest printing format extending as far as the radius F1, that is to say the effective circumferential length of the cylinder pit 15*b* is at its least. For smaller printing formats, a filler piece correspondingly shorter in the circumferential direction is used. For the smallest printing format indicated by the radius F2, a correspondingly narrow filler piece is used, and the printing covering 53 then extends at a lower inclination in its region engaging into the relatively long cylinder pit 15*b*, as represented by dot-and-dash lines in FIG. 10. To change the effective circumferential length of a cylinder pit, therefore, the actual fastening of the two ends of the printing covering by means of the clamping shaft 58 or the clamping piece 59 need not be modified, and it is sufficient to lengthen or shorten the cylinder sector, that is to say the support for the printing covering, by means of a filler piece of suitable size.

As regards a blanket cylinder of the indirectly printing printing unit A, the procedure is that, in order to adjust the circumferential length of the cylinder pit, the support for the blanket is appropriately dimensioned, that is to say appropriately trimmed. The larger the circumferential length of the cylinder pit, the longer the period of time available for executing a pilgrim-step mode.

With the combined printing machine described with reference to the drawings, it is possible to produce, on the front side of the web, a four-color wet offset print or, if the dampening units are inoperative and dry offset plates are used, a dry offset print or a combination of the two and a four-color intaglio print consisting of a three-color collect print and of a single-color direct intaglio print and, on the reverse side of the web, likewise a four-color offset print and a four-color intaglio print. The invention is not restricted to the exemplary embodiment described, but permits of many alternative versions as regards the type, number and sequence of the printing units, the type of control of the draw-roller units and the construction of the suction rollers. Not only printing units, but also, for example, perforating units and/or cutting units can be combined with the printing machine in the way described above.

We claim:

1. A combined rotary web-fed printing machine, with at least two printing units (A, B) arranged in succession and with a transport device conveying the paper in the form of a web (P) through the printing units and equipped with continuously driven draw-roller arrangements (27, 34, 34'), wherein the printing units (A, B) have respective cylinders (2, 3; 14, 15), including printing and impression cylinders forming the printing nip, each cylinder having a plurality of sectors separated by cylinder pits, wherein, as seen in a transport direction, the transport device possesses, in front of the printing nip of each printing unit (A, B), a first paper-web store (29; 37) and a following intermittently controllable first draw-roller unit (30; 38) and, after the printing nip of each printing unit (A, B), an intermittently controllable second draw-roller unit (31; 39) and a following second paper-web store (32; 40); control means including a regulating and control system for said first and second draw-roller units; said control system including individually regulated drives for each said draw-roller unit and means for intermittently controlling said draw-roller units for forward and backward movement of the web by said individually regulated drives for performing register and printing length correction, and wherein at least one of said continuously driven draw-roller arrangements (27, 34, 34') is installed respectively in front of the first paper-web store (29) of the first printing unit (A), between the second paper-web store (32) of the first printing unit and the first paper-web store (37) of the second printing unit (B), and behind the second paper-web store (40) of the second printing unit, in such a way that the paper web is transported uniformly in front of the first paper-web store of the second printing unit, behind the second paper-web store of the second printing unit, and between the two printing units (A, B), within a portion limited by the respective paper-web stores (32, 37).

2. The rotary web-fed printing machine as claimed in claim 1, wherein said at least two printing units include an indirect printing unit (A) and at least one intaglio printing unit (B).

3. The rotary web-fed printing machine as claimed in claim 2, wherein three printing units (A, B, C) are provided, the first printing unit, as seen in the transport direction, being the indirectly printing printing unit (A) which is designed for simultaneous recto-verso printing and which has two interacting blanket cylinders (2, 3), wherein the second and the third printing unit (B, C) are intaglio printing units which respectively print one side of the web and then the other with a multicolor intaglio print, the last intaglio printing unit also being equipped, on both sides of its printing nip, with paper-web stores (37', 40') and with intermittently controllable draw-roller units (38', 39'), and wherein the transport device possesses a drying device printing units and preferably also behind the last intaglio printing unit.

4. The rotary web-fed printing machine as claimed in claim 2, wherein the first printing unit is an intaglio printing unit which is followed by the indirectly printing printing unit and an intaglio printing unit.

5. The rotary web-fed printing machine as claimed in claim 1, wherein each of said draw-roller units (30, 31; 38, 39) has one suction roller (**30*b*, 31*b*; 38*b*, 39*b***) as a draw roller, in which suction means provide a constantly acting suction effect active along a circumferential portion round which the paper web is looped, whilst a remaining circumferential portion of said suction roller undergoes no suction effect, and wherein the looping extends preferably over 180°.

6. The rotary web-fed printing machine as claimed in claim 5, wherein each suction roller of the draw-roller unit consists of a fixed hollow roller core (65) and of a roller casing (61) rotatable about said core and made of light material, with suction ports (62) distributed over its circumference, a drive motor having a rotor shaft, wherein the roller core (65) is equipped on its one side with an axial connection piece (**68*b*) for fastening to a machine stand and for connection to a vacuum source, on its other side with a bearing journal (66) and on its circumference with two radial partition walls (69) arranged at a specific angular distance from one another and enclosing a suction chamber (72) between them, wherein the circumferential wall of the roller core (65) within the suction chamber has passage orifices (70), and wherein an end of the roller casing (61) facing away from the connection piece (68*b*) tapers conically to form a connecting flange (61*b*) which is intended for fastening to said rotor shaft of said drive motor and which is mounted rotatably on the bearing journal (66) by means of a bearing (71), whilst another end of the roller casing (61) is equipped with a flanged part (63) mounted by means of a bearing (71') on the connection piece (68*b*), and gaps provided between an inner circumference of the roller casing (61) and radially outer ends of the partition walls (69**) being approximately airtight.

7. The rotary web-fed printing machine as claimed in claim 6, wherein fastened to the two ends of the roller core (65) are annular walls (67, 68) which close off the suction chamber (72) mentioned at the two axial ends, and wherein are gaps provided between inner said circumference of the roller casing (61) and an outer circumference of the annular walls which are approximately airtight, the annular wall (68) located on the same side as the connection piece preferably being in one piece with the connection piece (68*b*).

8. The rotary web-fed printing machine as claimed in claim 7, wherein sealing material (73), is arranged in said gaps.

9. The rotary web-fed printing machine as claimed in claim 7, wherein said gaps are so small that they generate an air resistance sufficient for maintaining the desired vacuum in the suction chamber (72).

10. The rotary web-fed printing machine as claimed in claim 6, wherein the roller casing (61) consists of carbon fibers impregnated with plastic.

11. The rotary web-fed printing machine as claimed in claim 6, wherein adjacent suction ports (62) in the roller casing (61) are respectively arranged offset angularly in such a way that they extend along helical portions arranged in a zigzag-shaped manner.

12. The rotary web-fed printing machine as claimed in claim 1, wherein said printing units include has an intaglio printing unit (B, C), and wherein, when there is a change of a length of the printing format, the circumferential length of the cylinder pits (15*b*, 15*b'*) of the impression cylinder can be varied by means of exchangeable filler pieces of differing length (54), on which an end region of a printing covering (53) is supported.

13. The rotary web-fed printing machine as claimed in claim 1, wherein said printing units include an indirect printing unit (A) with two blanket cylinders (2, 3) carrying blankets supported by blanket backings, said blanket cylinders forming the printing nip and having said cylinder pits, and wherein, when there is a change of the length of the printing format, on at least one of said blanket cylinders the circumferential length of the cylinder pits (2*b*, 3*b*) can be varied by an appropriate adaptation of the blanket backings.

14. The rotary web-fed printing machine as claimed in claim 1, wherein the regulating and control system for the two draw-roller units of each printing unit has a pilgrim-step generator (PS) receiving signals relating to the desired repeat length (RL), a first comparator (V1) designed to compare the position (x) of a register mark read off on the paper web (P) with the angular position ($\Psi$) of the printing-unit cylinders and to determine a deviation ($\Delta x$) from the ideal position of the register mark, a second comparator (V2) designed to compare the read-off printing length (DLi) of the print generated in each printing unit with the angular position ($\Psi$) of the printing-unit cylinders and to determine a possible deviation ($\Delta L$) from the desired printing length, and a controller (R), in the form of a process computer, which is connected to the pilgrim-step generator (PS) and the two comparators (V1, V2) for receiving, signals relating to the angular position ($\Psi$) of the printing-unit cylinders and the angular position ($\alpha i$, $\beta i$) of the draw-roller units (30, 31) and relating to the desired printing length (DL) and two power output stages (LSTG) respectively corrected to said drives of said draw-roller units (30, 31), said controller having means to transmit control quantities to two power output stages (LSTG) for controlling the two drives of the draw-roller units (30, 31).

15. The rotary web-fed printing machine as claimed in claim 14, wherein an overriding process computer (PR) is provided for the machine as a whole and coordinates and optimizes the regulating and control system of each printing unit (A, B, C).

16. The machine as claimed in claim 8 wherein said sealing material includes self-adhesive brushes.

* * * * *